United States Patent [19]

Ferrera

[11] Patent Number: 5,012,931

[45] Date of Patent: May 7, 1991

[54] Z-SHAPED DUAL-COMPARTMENT RESEALABLE DISPENSING CONTAINER

[76] Inventor: John Ferrera, P.O. Box 1032, San Juan Bautista, Colo. 95045

[21] Appl. No.: 571,333

[22] Filed: Aug. 22, 1990

Related U.S. Application Data

[63] Continuation-in-part of Ser. No. 396,526, Aug. 22, 1989.

[51] Int. Cl.[5] ..... B65D 75/40

[52] U.S. Cl. ..... 206/631.100; 383/86

[58] Field of Search ..... 206/205, 209, 361, 494, 206/613, 620, 626, 629, 631, 631.1, 632, 633, 812; 229/72; 383/86, 86.1

[56] References Cited

U.S. PATENT DOCUMENTS

| | | | |
|---|---|---|---|
| 663,202 | 12/1900 | Walter | 229/72 |
| 4,194,631 | 3/1980 | Rangan | 206/632 |
| 4,410,130 | 10/1983 | Herrington | 206/632 |
| 4,420,080 | 12/1983 | Nakamura | 206/494 |
| 4,428,477 | 1/1984 | Cristofolo | 206/632 |
| 4,522,305 | 6/1985 | Jacobsson | 206/632 |
| 4,552,269 | 11/1985 | Chang | 206/632 |
| 4,610,357 | 9/1986 | Nakamura | 206/629 |
| 4,651,874 | 3/1987 | Nakamura | 206/629 |
| 4,739,879 | 4/1988 | Nakamura | 206/205 |
| 4,790,436 | 12/1988 | Nakamura | 206/449 |

*Primary Examiner*—Jimmy G. Foster

*Attorney, Agent, or Firm*—John R. Flanagan

[57] ABSTRACT

A flexible dispensing container employs a single sheet of flexible packaging material folded upon itself in a Z-configuration about a pair of parallel spaced fold lines extending parallel to a longitudinal dimension of the sheet and sealed to itself at its unfolded peripheral edges, thereby forming upper, lower and middle wall portions of the container which defined upper and lower dual compartments on opposite sides of the middle wall portion. Labels are removable from and resealable to gaskets on the exteriors of the upper and lower wall portions for permitting opening and closing of the dual compartments of the dispensing container. Each label has a resealable adhesively-coated seal surface that surrounds a central non-coated closure panel attached to the label. Exterior surfaces of the upper and lower wall portions have resealable adhesively-coated gaskets deposited thereon surrounding central apertures formed through the upper and lower wall portions to permit access to the dual upper and lower compartments. The labels can be reapplied to the gaskets and the closure panels placed in registry with the apertures to resealably close the dual compartments.

15 Claims, 3 Drawing Sheets

Z-SHAPED DUAL-COMPARTMENT RESEALABLE DISPENSING CONTAINER

CROSS REFERENCE TO RELATED APPLICATION

This application is a continuation-in-part of copending U.S. Pat. application Ser. No. 396,526, filed Aug. 22, 1989.

BACKGROUND OF THE INVENTION

1. Field of the Invention

The present invention generally relates to flexible resealable dispensing containers for packaging goods and, more particularly, is concerned with a flexible Z-shaped dual-compartment resealable dispensing container.

2. Description of the Prior Art

Many different products, both wet and dry and ranging from foods to personal use goods, are packaged in flexible dispensing containers. Flexible dispensing containers having single storage pockets or compartments and resealable sealing flaps have been proposed in the prior art, as exemplified by U.S. Pat. No. (4,552,269) to Chang and Nakamura (U.S. Pat. Nos. 4,739,879 and 4,790,436).

In addition to flexible dispensing containers having single storage compartments, U.S. Pat. No. 4,739,879 to Nakamura discloses dispensing containers have double or dual compartments for packaging different goods. Each compartment is separate from the other and has its own resealable sealing flap. The patent discloses flexible dispensing containers with main bodies having either single or double compartments formed by bonding longitudinal and transverse edges of two or more superimposed sheets of flexible plastic film together.

The provision of a flexible dispensing container with double compartments increases the versatility of such packages. However, difficulties arise during fabrication in maintaining accurate registry and alignment of the separate sheets for producing the containers.

Consequently, a need still exists for improvements in the design of flexible dispensing containers with more than one compartment.

SUMMARY OF THE INVENTION

The present invention provides a flexible Z-shaped dual-compartment resealable dispensing container designed to satisfy the aforementioned needs. The dispensing container of the present invention advantageously employs a single sheet of flexible packaging material having perimeter or peripheral edges. The sheet is folded upon itself into a Z-configuration about a pair of parallel spaced fold lines extending parallel to a longitudinal dimension of said sheet and sealed to itself at its unfolded edges. The folded sheet thus forms upper, lower and middle wall portions of the final dual compartment container.

More particularly, first and second diagonally-spaced folds in the sheet integrally connect the upper and lower wall portions at different ones of their respective opposite longitudinal side edges to respective opposite longitudinal side edges of the middle wall portion. Dual compartments are defined in the container by seals provided between the free, non-connected opposite longitudinal side edges and transverse end edges of the upper and lower wall portions and corresponding opposite surface regions along longitudinal side and transverse end edges of the middle wall portion.

Further, labels are removable from and resealable to gaskets on the exteriors of the upper and lower wall portions for permitting opening and closing of the dual compartments of the dispensing container. Each label has a resealable adhesively-coated seal surface that surrounds a central non-coated closure panel attached to the label. Exterior surfaces of the upper and lower wall portions have resealable adhesively-coated gaskets deposited thereon surrounding central apertures formed through the upper and lower wall portions to permit access to the dual upper and lower compartments. The labels can be reapplied to the gaskets and the closure panels replaced in registry with the apertures to resealably close the dual compartments.

Also, narrow flanges can be provided on the free, non-connected ones of the longitudinal side edges of the upper and lower wall portions of the Z-folded sheet. The flanges can be wrapped around and sealed over the opposite longitudinal folds of the sheet for reinforcing and strengthening the dual compartment container.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
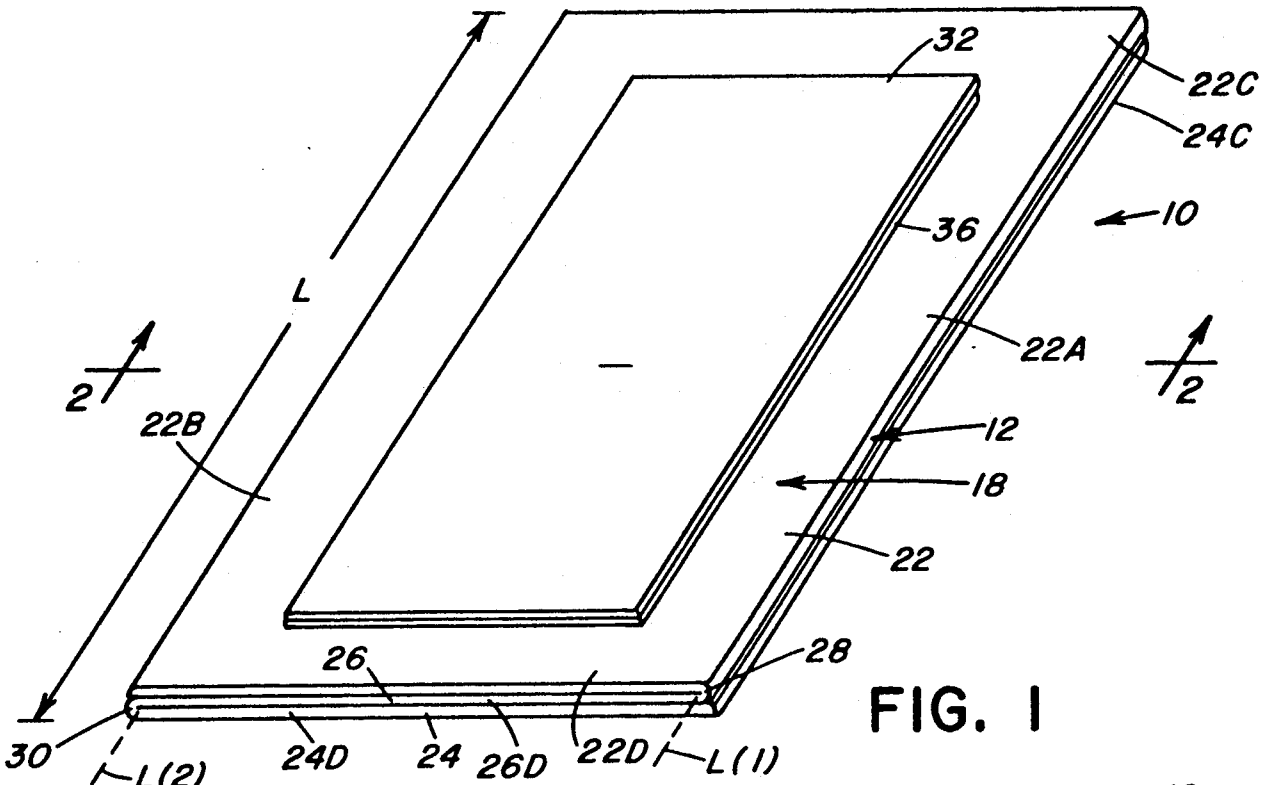
FIG. 1 is a perspective view of a flexible Z-shaped dual-compartment resealable dispensing container of the present invention.

In the following description, like reference characters designate like or corresponding parts throughout the several views of the drawings. Also in the following description, it is to be understood that such terms as "upper", "lower", "forward", "rearward", and the like, are words of convenience and are not to be construed as limiting terms.

Figure 2:
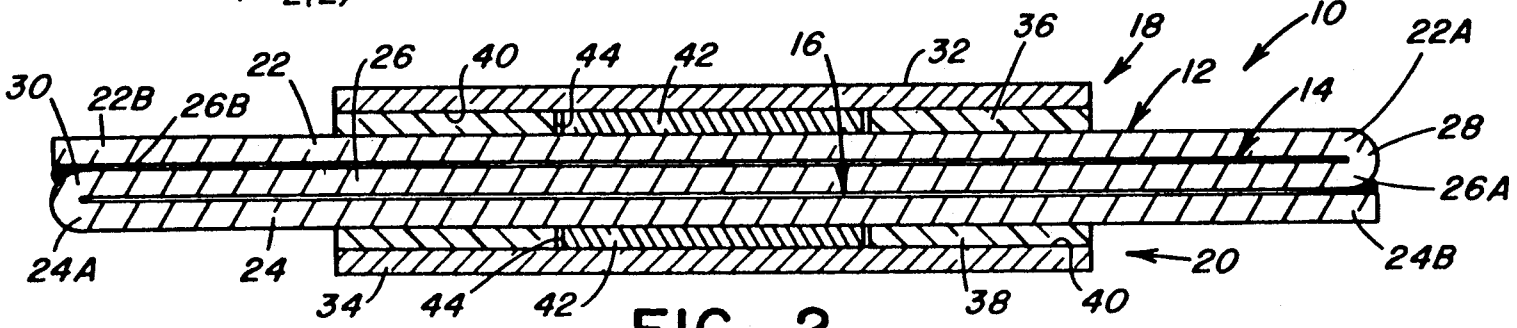
FIG. 2 is an enlarged transverse sectional view of the container taken along line 2—2 of FIG. 1.
Figure 3:
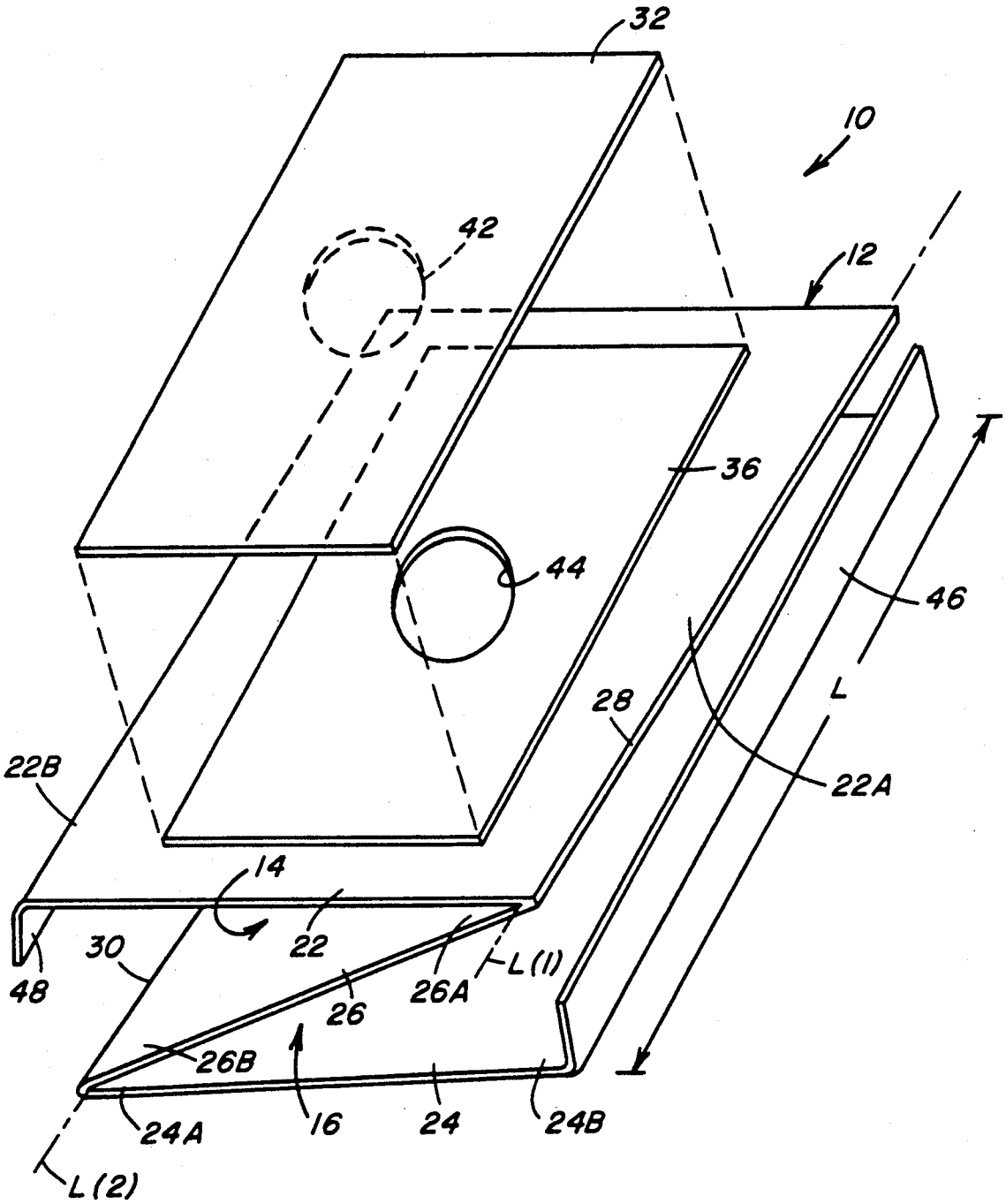
FIG. 3 is a perspective view of the container of FIG. 1 prior to sealing of the upper, lower and middle wall portions together to form the dual compartments.

Referring to the drawings, and particularly to FIGS. 1–3, there is shown a flexible Z-shaped dual-compartment resealable dispensing container of the present invention, generally designated 10. Basically, the flexible dispensing container 10 is composed of a single sheet 12 of flexible packaging material forming separate double or dual upper and lower compartments 14 and 16, and a pair of separate upper and lower closure means 18 and 20. The sheet 12 is folded upon itself into a Z-configuration about a pair of parallel spaced fold lines L(1) and L(2) extending parallel to a longitudinal or lengthwise dimension L of the sheet 12 and is sealed to itself at its unfolded peripheral edges to define the dual upper and lower compartments 14, 16. The sheet 12 can be composed of a single layer of a suitable packaging material, or of a plurality of laminated layers thereof. The packaging material can be any suitable material used for packaging purposes, such as a film made of a synthetic resin imperious to gases and liquids.

The Z-shaped folded sheet 12 forms upper, lower and middle wall portions 22, 24 and 26 of the container 10. The upper wall portion 22 of the sheet 12 has pairs of opposite longitudinal side edges 22A and 22B and opposite transverse end edges 22C and 22D. The lower wall portion 24 of the sheet 12 has pairs of opposite longitudinal side edges 24A and 24B and opposite transverse end edges 24C and 24D. The middle wall portion 26 of the sheet 12 has pairs of opposite longitudinal side edges 26A and 26B and opposite end edges 26C and 26D.

Also, the upper wall portion 22 of the sheet 12 is integrally connected at its one opposite longitudinal side edge 22A by a first longitudinal fold 28 in the sheet 12 with one opposite longitudinal side edge 26A of the middle wall portion 26. The lower wall portion 24 of the sheet 12 is integrally connected at its one opposite longitudinal side edge 24A by a second longitudinal fold 30 in the sheet 12 with the other opposite longitudinal side edge 26B of the middle wall portion 26. The first and second folds 28, 30 of the sheet 12 are located at diagonally opposite edges of the dispensing container 10.

The dual upper and lower compartments 14, 16 are defined in the container 10 by the folds 28, 30 and by seals provided on the free, non-connected and remaining opposite longitudinal side edges 22B, 24B and transverse end edges 22C, 22D and 24C, 24D of the upper and lower wall portions 22, 24. Specifically, these edges are sealed to the opposite surface regions along the longitudinal side edges 26A, 26B and transverse end edges 26C, 26D of the middle wall portion 26 by any suitable method, such as heat, sonic or pressure sealing. Filling of the dual compartments 14, 16 with products can be carried out prior to sealing the transverse end edges 22C, 22D and 24C, 24D of the upper and lower wall portions 22, 24 to the transverse end edges 26C, 26D of the middle wall portion 26.

The separate upper and lower closure means 18 and 20 of the container 10 can take several forms. Referring to FIGS. 1–3, one preferred form is upper and lower tabs or labels 32 and 34 removable from and resealable to upper and lower gaskets 36 and 38 provided on the exteriors of the upper and lower wall portions 22, 24 for permitting opening and closing of the dual compartments 14 and 16 of the dispensing container 10. Each label 32, 34 can be fabricated from the same material as the sheet 12. Each label 32, 34 has a resealable adhesively-coated pressure-sensitive seal surface 40 that surrounds a central non-coated closure panel 42 attached to the label 32, 34.

Further, the respective exterior surfaces of the upper and lower wall portions 22, 24 have the resealable adhesively-coated gaskets 36, 38 deposited thereon and surrounding central apertures 44 formed through the upper and lower wall portions 22, 24 so as to provide access to the dual upper and lower compartments 14, 16. The labels 32, 34 can be easily applied and reapplied to the gaskets 36, 38 with the closure panels 42 placed and replaced in registry with the dispensing apertures 44 to initially sealably and later resealably close the compartments 14, 16. The gaskets 36, 38 and apertures 44 are respectively applied to and formed in the upper and lower wall portions 22, 24 before the sheet 12 is folded into the Z-configuration.

Also, narrow upper and lower strips or flanges 46 and 48 can be provided on the free, unconnected ones of the longitudinal side edges 22B, 24B of the upper and lower wall portions 22, 24 of the sheet 12. The flanges 46, 48 can be wrapped around and sealed over the opposite first and second longitudinal folds 28, 30 of the sheet 12 for reinforcing and strengthen the dual compartment container 10.

Figure 4:
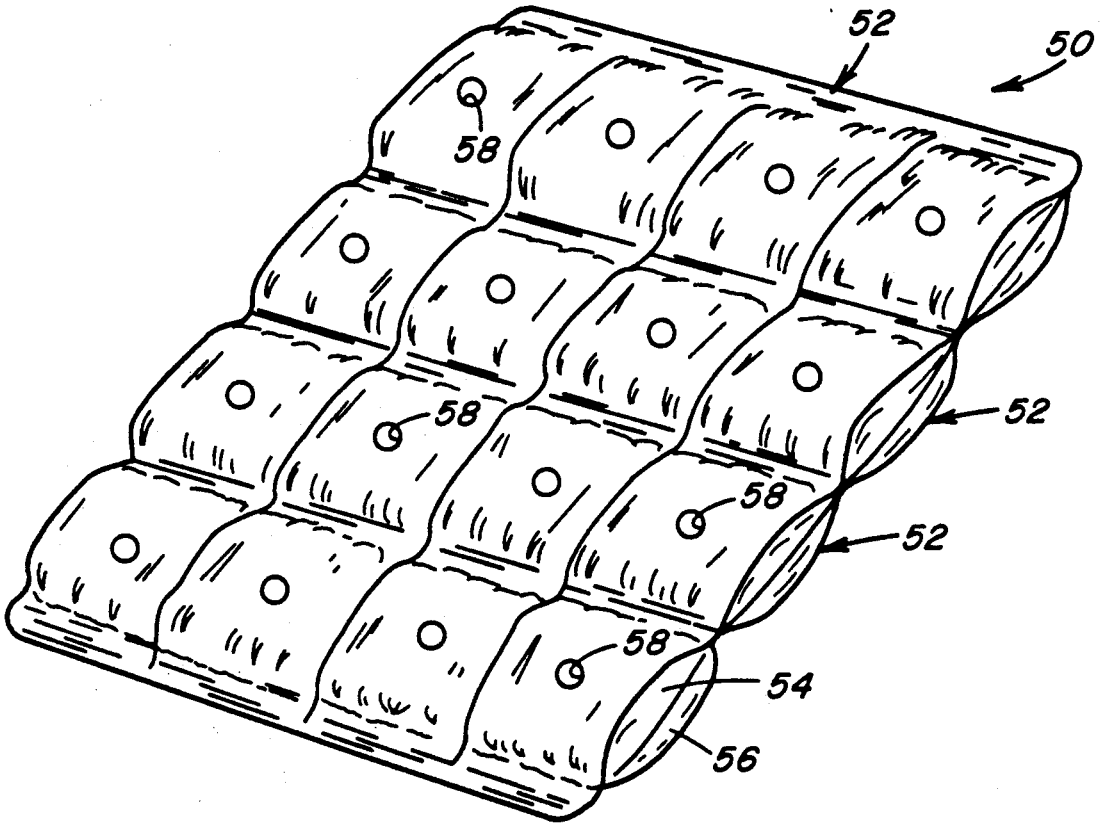
FIG. 4 is a perspective view a flexible Z-shaped dispensing container having multiple sets of dual compartments.

Referring to FIG. 4, there is illustrated a flexible Z-shaped dispensing container 50 having multiple sets 52 of dual upper and lower compartments 54, 56. The Z-shaped dispensing container 50 is constructed similarly to the above-described container 10. In addition, seals are made in criss cross fashion so as to subdivide one large set of dual compartments into multiple sets 52 of smaller ones. Also, during fabrication pairs of apertures 58 matched to the number of sets 52 are formed in the sheet before being folded into the Z-configuration. Filling of the sets 52 of compartments with products would take place through their individual apertures 58.

The advantages of the flexible Z-shaped dual compartment dispensing container 10 of the present invention are many. First, the Z-configuration provides the container with superior strength in structure without further degradation to the environment over existing packages. Second, the container has better air-tight and water-tight seals, thereby decreasing evaporation and odors. Third, it is easier to remove contents due to the gasket placed upon the surface of the flexible sheet material. Fourth, the gasket and label configuration increased the strength of flexible sheet materials as well as increases the applications of the container. Fifth, the resealable Z-shaped container does not pass on adhesive odors and does not contaminate the compartments or the materials therein. Sixth, the presence of the gaskets around the apertures reduces the possibility of tearing and ripping of the flexible sheet material around the apertures while dispensing and increases the smoothness at which the contents can be removed from the container. The applications for the container encompass the entire packing industry from foods, as in complete meals designed for freezing and heating, to medical supplies which are pre-measured and numbered for dispensing.

It is thought that the present invention will be understood from the foregoing description and it will be apparent that various changes may be made thereto without departing from its spirit and scope or sacrificing all of its material advantages, the form hereinbefore described being merely preferred or exemplary embodiment thereof.

Having thus described the invention, what is claimed is:

1. A flexible dispensing container, comprising:

(a) a single sheet of flexible packaging material having peripheral edges, said sheet being folded upon itself into a Z-configuration about a pair of parallel spaced fold lines extending parallel to a longitudinal dimension of said sheet and sealed to itself at its unfolded peripheral edges;

(b) said Z-folded sheet forming upper, lower and middle wall portions defining separate dual compartments on opposite upper and lower sides of said middle wall portion; and (c) separate means resealably attached to exteriors of said upper and lower wall portions for permitting separate opening and closing of said compartments.

2. The container of claim 1 wherein said upper wall portion of said Z-folded sheet has pairs of opposite longitudinal side edges and opposite transverse end edges.

3. The container of claim 2 wherein said lower wall portion of said Z-folded sheet has pairs of opposite longitudinal side edges and opposite transverse end edges.

4. The container of claim 3 wherein said middle wall portion of said Z-folded sheet has pairs of opposite longitudinal side edges and opposite end edges.

5. The container of claim 4 wherein said upper wall portion is integrally connected at its one opposite longitudinal side edge by a first longitudinal fold in said sheet with one opposite longitudinal side edge of said middle wall portion.

6. The container of claim 5 wherein said lower wall portion is integrally connected at its one opposite longitudinal side edge by a second longitudinal fold in said sheet with the other opposite longitudinal side edge of said middle wall portion.

7. The container of claim 6 wherein said first and second longitudinal folds in said sheet are located at diagonally opposite edges of said dispensing container.

8. The container of claim 6 wherein said upper and lower wall portions of said Z-shaped sheet have flanges attached to said other of their longitudinal side edges, said flanges being wrapped around and sealed over said respective first and second longitudinal folds in said sheet for reinforcing and strengthening said dual compartment container.

9. The container of claim 1 wherein said opening and closing means for each compartment includes a resealable adhesively-coated gasket deposited on an exterior of each of said upper and lower wall portions and surrounding an aperture formed through each said upper and lower wall portion to permit access to each said compartment.

10. The container of claim 9 wherein said opening and closing means for each compartment includes a label having a central non-coated closure panel attached thereto and a resealable adhesively-coated seal surface on said label surrounding said closure panel, said label being reappliable to said gasket and said closure panel on said label being replacable in registry with said aperture to resealably close said compartment.

11. A flexible dispensing container, comprising:

(a) a single sheet of packaging material being folded upon itself into a Z-configuration about a pair of parallel spaced fold lines extending parallel to a longitudinal dimension of said sheet;

(b) said Z-folded sheet forming upper, lower and middle wall portions each having opposite longitudinal side edges and opposite transverse end edges;

(c) said upper wall portion at one of said opposite longitudinal side edges thereof being connected by a first longitudinal fold of said sheet with one of said opposite longitudinal side edges of said middle wall portion, said upper wall portion at the other of said opposite longitudinal side edges thereof being connected by a first seal with the other of said opposite longitudinal side edges of said middle wall portion;

(d) said lower wall portion at one of said opposite longitudinal side edges thereof being connected by a second longitudinal fold of said sheet with the other of said opposite longitudinal side edges of said middle wall portion, said lower wall portion at the other of said opposite longitudinal side edges thereof being connected by a second seal with the one of said opposite longitudinal side edges of said middle wall portion;

(e) said upper and lower wall portions at opposite transverse end edges thereof being connected by third and fourth seals with said opposite transverse end edges of said middle wall portion such that said opposite side folds and seals and said opposite end seals connecting said upper and lower wall portions with said middle wall portion defined separate dual compartments on opposite upper and lower sides of said middle wall portion; and (f) separate means resealably attached to exteriors of said upper and lower wall portions for permitting separate opening and closing of said compartments.

12. The container of claim 11 wherein said first and second longitudinal folds in said sheet are located at diagonally opposite edges of said dispensing container.

13. The container of claim 11 wherein said opening and closing means for each compartment includes a resealable adhesively-coated gasket deposited on an exterior of each of said upper and lower wall portions and surrounding an aperture formed through each said upper and lower wall portion to permit access to each said compartment.

14. The container of claim 13 wherein said opening and closing means for each compartment includes a label having a central non-coated closure panel attached thereto and a resealable adhesively-coated seal surface on said label surrounding said closure panel, said label being reappliable to said gasket and said closure panel on said label being replacable in registry with said aperture to resealably close said compartment.

15. The container of claim 11 wherein said upper and lower wall portions of said Z-shaped sheet have flanges attached to said other of their longitudinal side edges, said flanges being wrapped around and sealed over said respective first and second longitudinal folds in said sheet for reinforcing and strengthening said dual compartment container.

* * * * *